US006173530B1

(12) United States Patent
Holt

(10) Patent No.: US 6,173,530 B1
(45) Date of Patent: Jan. 16, 2001

(54) BARREL WATER GARDENS

(76) Inventor: Andy Holt, 2507 E. 21st St., Des Moines, IA (US) 50317

( * ) Notice: Under 35 U.S.C. 154(b), the term of this patent shall be extended for 0 days.

(21) Appl. No.: 08/984,113

(22) Filed: Dec. 3, 1997

(51) Int. Cl.[7] ..... A01G 9/02; B65D 6/00

(52) U.S. Cl. ..... 47/66.1; 47/65.5; 47/59; 47/79; 217/88; 217/96; 220/4.11

(58) Field of Search ..... 47/65.5, 66.6, 47/75, 79, 82, 83, 59, 33, 66.1; 217/88, 96, 3 CB; 220/4.09, 4.11, 23.9

(56) References Cited

U.S. PATENT DOCUMENTS

| | | | | |
|---|---|---|---|---|
| D. 313,203 | * | 12/1990 | Carlson | D11/153 |
| 396,459 | * | 1/1889 | Bertrand | 47/66.1 |
| 764,545 | * | 7/1904 | Arkell | 217/3 CB |
| 975,679 | * | 11/1910 | Dupree | 217/91 |
| 983,300 | * | 2/1911 | Mix | 217/44 |
| 1,541,749 | * | 6/1925 | Hommel | 217/91 |
| 1,932,748 | * | 10/1933 | Peck et al. | 47/66.1 |
| 2,466,542 | * | 4/1949 | Gilmore | 217/44 |
| 4,174,589 | * | 11/1979 | Daharsh | 47/66.6 |
| 4,335,540 | * | 6/1982 | Allen | 47/79 |
| 4,991,346 | * | 2/1991 | Costa, Jr. et al. | 47/80 |
| 5,011,034 | * | 4/1991 | Abel | 220/23.86 |

FOREIGN PATENT DOCUMENTS

| | | | | |
|---|---|---|---|---|
| 849895 | * | 12/1939 | (FR) | 47/66.1 |
| 2423143 | * | 12/1979 | (FR) | 47/66.1 |
| 94027424 | * | 12/1994 | (WO) | 47/41.01 |

OTHER PUBLICATIONS

Gardener's Supply Company, Spring 1999 catalogue, American Village Fountain, p. 17.*

Oak Barrell Productions, Grower's Tub Special, Product# 7012.*

* cited by examiner

*Primary Examiner*—Michael J. Carone
*Assistant Examiner*—James S. Bergin
(74) *Attorney, Agent, or Firm*—Frank A. Lukasik

(57) ABSTRACT

A simulated barrel garden for aquatic and terrestrial plants comprising a circumferential sidewall consisting of two sections of vertically extending barrel staves having a plurality of straps fastening the staves together in assembled relation, a barrel liner being inserted into the sidewall and mating with the sidewall top edges and forming a rigid, stand alone half barrel supporting the weight of the garden and a water related accessory mounted on a mounting bracket and fastened to the top rim of the liner. A second embodiment includes a cascade notch in the sidewall and a mating cascade lip formed in the barrel liner. Two additional embodiments of the barrel liner include a planter ring with a shelf in the center or a hole in the center.

7 Claims, 20 Drawing Sheets

BARREL WATER GARDENS

BACKGROUND OF THE INVENTION

1. Field of the Invention

The present invention relates generally to a water garden and more particularly to a simulated barrel which requires barrel liners to retain the water for growing aquatic plants.

2. Description of the Prior Art

Stacking containers to provide varying plant displays is well known and in use for many years. Planters comprising a series of stacked plant containers connected by means for distributing water to lower containers in the stack are also well known. Also well known is the use of barrels as plant containers. U.S. Pat. No. 1,932,748 to Peck et al discloses a garden tub containing a bottom, and a circumferential side wall. The side wall is formed of a plurality of vertically extending staves held up in assembled relation by hoops. The bottom is provided with a plurality of perforations to permit the downward escape of excess moisture.

U.S. Pat. No. 5,404,673 to Anderson discloses a modular column planter comprising a lower, middle, and an upper container. Each container has a bottom connecting with a sidewall that extends upwardly to define a top opening. On the lower container is a post having a slotted, top retaining cup. Positioned about an opening in a bottom of the middle and upper container is an upright, hollow column and a lower column extension. A top edge of the middle container column is notched while a bottom edge of the upper container lower column extension is slotted. The planter is formed by fitting respectively the bottom of the middle and upper container in the top opening of the middle and upper container.

U.S. Pat. No. 5,491,928 to Potochnik discloses a dual wall plant container for collecting excess water draining from root containing soil medium is formed by a pair of telescoped plant containers having different depths and cooperating lip and lug members engaged and projecting radially outward from their upper rims for supporting the inner container bottom wall in spaced relation with respect to the outer container bottom wall to form a liquid containing reservoir in the space therebetween.

U.S. Design Pat. No. Des. 313,203 to Carlson discloses a planter with an outer tub and an inner tub nestled inside.

The above references as well as other prior art devices disclose devices which deal with maintaining a certain level of water in the planter to prevent plant rot. None of the patents disclose a simulated barrel which may be easily assembled as the instant invention does.

It is one object of the invention to provide an affordable barrel which is all ready for quick assembly.

A further object is to provide improved means for elevating the water level for growing aquatic plants in a controlled environment indoors or outdoors.

Another object of the invention is to provide an affordable barrel which may be used for aquatic as well as terrestrial plants.

SUMMARY OF THE INVENTION

The barrel water garden of the invention consists of a circumferential side wall formed of a plurality of vertically extending barrel staves held in assembled relation by two strips of metal or plastic forming the hoops of the barrel. Barrel liners are used to retain the water for growing aquatic or the soil for terrestrial plants. In addition, barrel garden accessories are added to the barrel liners on a mounting bracket attached to the top rim of the barrel. When the sections of the barrel are assembled they simulate a genuine barrel such as the type used to age liquor. The barrel liners consist of a classic design which fits whiskey barrels, a barrel liner with a cascade lip which allows water to cascade to a second barrel, a planter ring which can be filled with soil for planting with a center hole to allow for the flow of water and a planter ring with a shelf for mounting accessories such as a non-working pump or other ornamentation.

Some of the barrel garden accessories comprise a cast iron vintage pump in colors or natural, an authentic aluminum country pump and a water bucket which adds to the sound of cascading water.

DETAILED DESCRIPTION OF THE INVENTION

Figure 1:
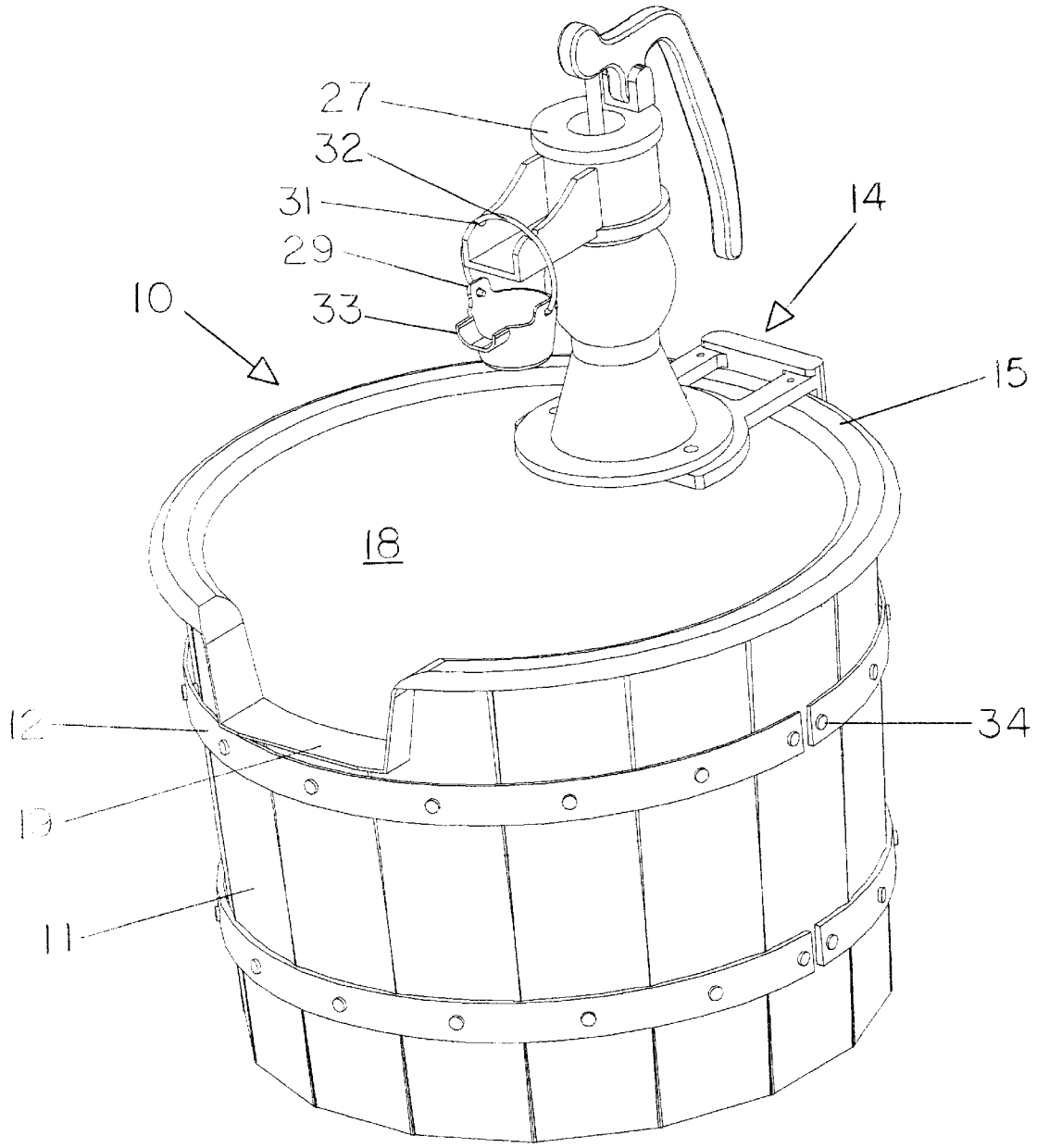
FIG. 1 is a top, perspective front view, of a barrel showing a cascade liner, with accessories mounted on a mounting bracket, in accordance with the invention.
Figure 2:
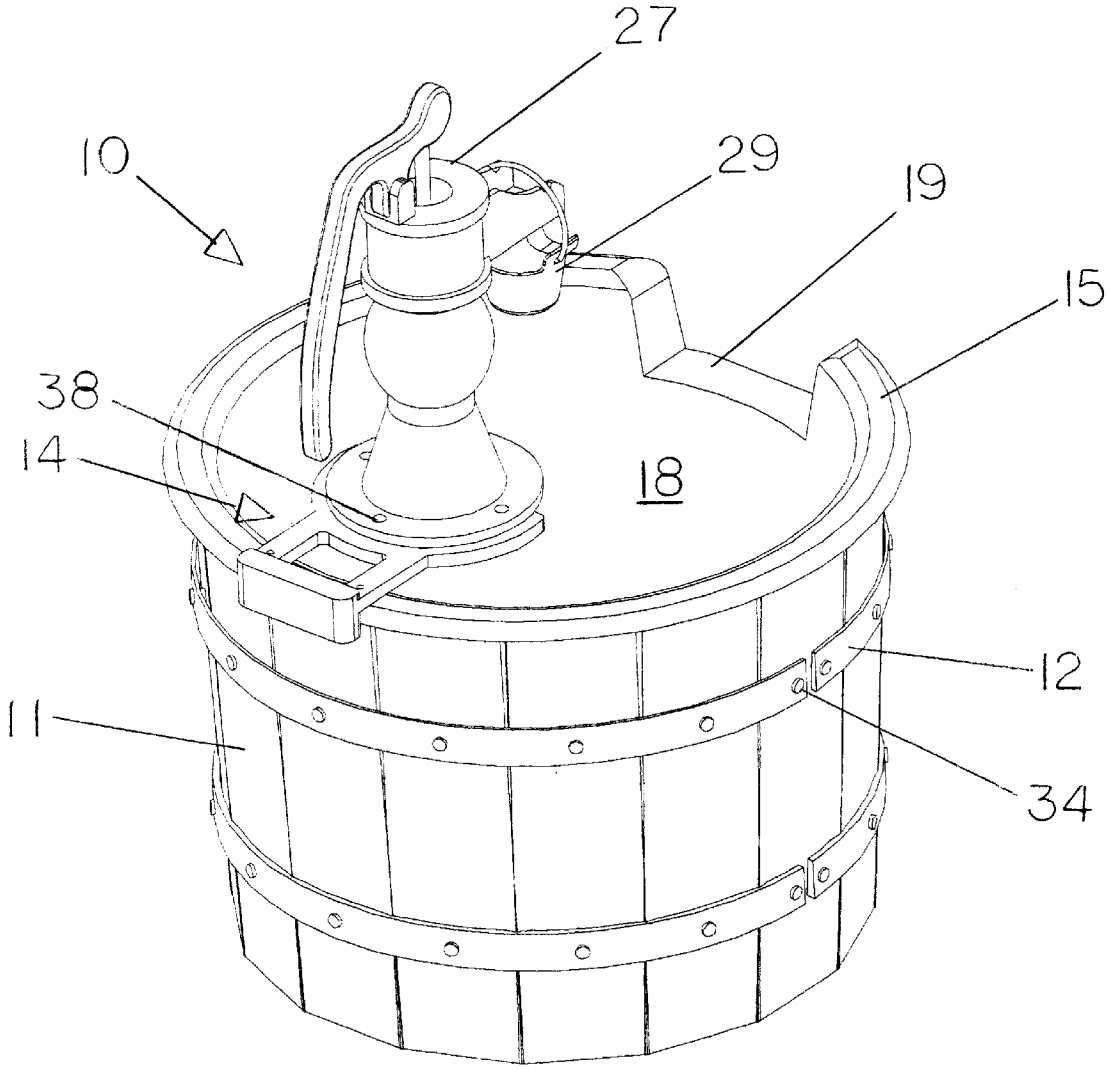
FIG. 2 is a top perspective rear view of a barrel in accordance with the invention.
Figure 3:
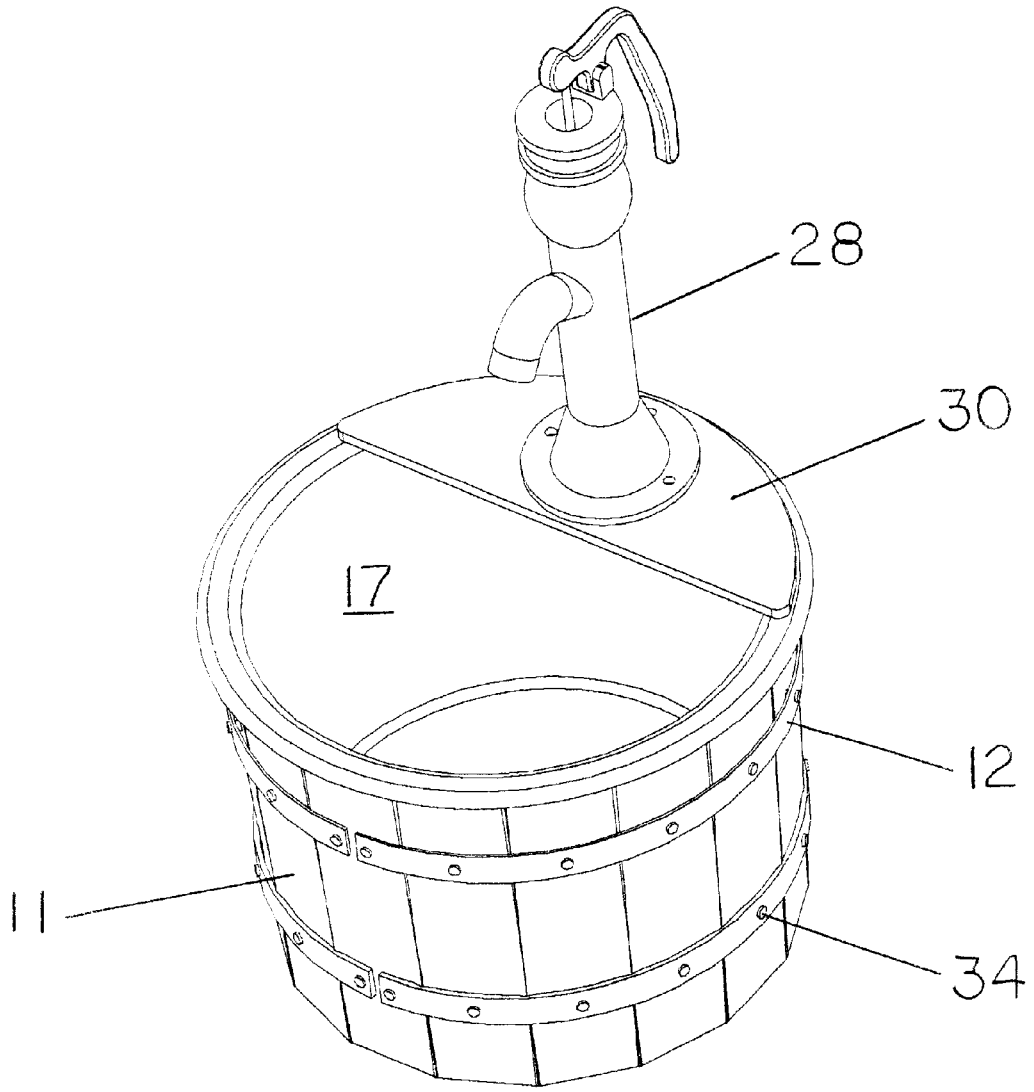
FIG. 3 is a top perspective front view of a classic design liner with accessories mounted in accordance with the invention.

Referring to FIGS. 1 through 4, a barrel water garden is designated generally by the numeral 10. The present invention consists of a circumferential side wall formed of a plurality of vertically extending barrel staves 12 held in assembled relation by two strips of metal or plastic barrel hoops 11. The barrel staves 11 are fastened to barrel hoops 12 with fasteners 34. In a preferred embodiment two sections 16, each having eight barrel staves 11, were used. Each of the barrel hoops 12 have a first end 48 fastened to a barrel stave 11 at one end of a section 16 and a second end 49 extending beyond a barrel stave 11 located at the opposite end of a section 16. In assembling the two sections 16 together, the sections are bent to form a circumferential sidewall and the extending hoop second ends 49 are fastened to the abutting stave 11 thereby closing the circle.

The barrel staves 11 are preferably made of wood, however, plastic, simulating wood grains, may also be used. The barrel staves 11 are shaped and dimensioned to duplicate the staves in a whiskey barrel.

Figure 15:
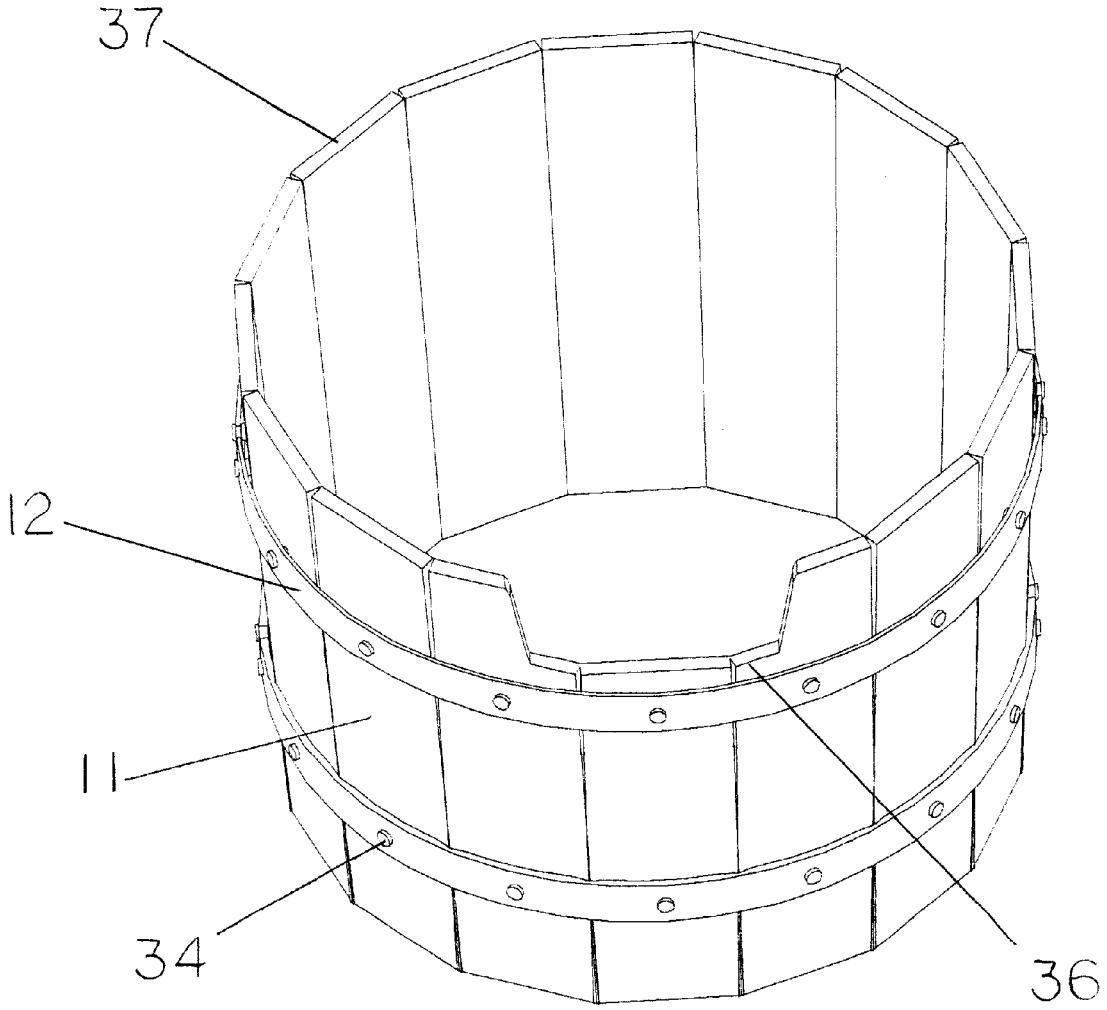
FIG. 15 is a top perspective view of a barrel notched to form a cascade in accordance with the invention.
Figure 16:
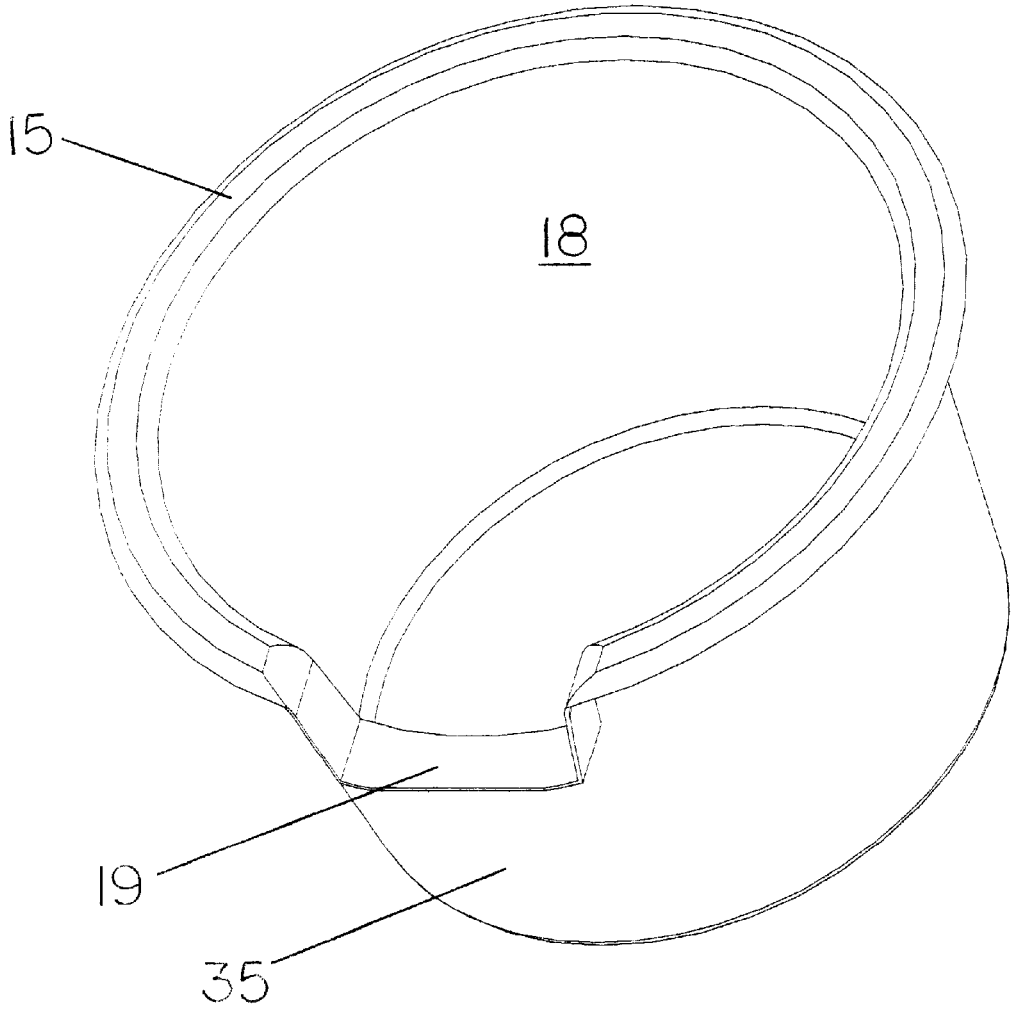
FIG. 16 is a top perspective view of a cascade liner having a cascade lip.
Figure 17:
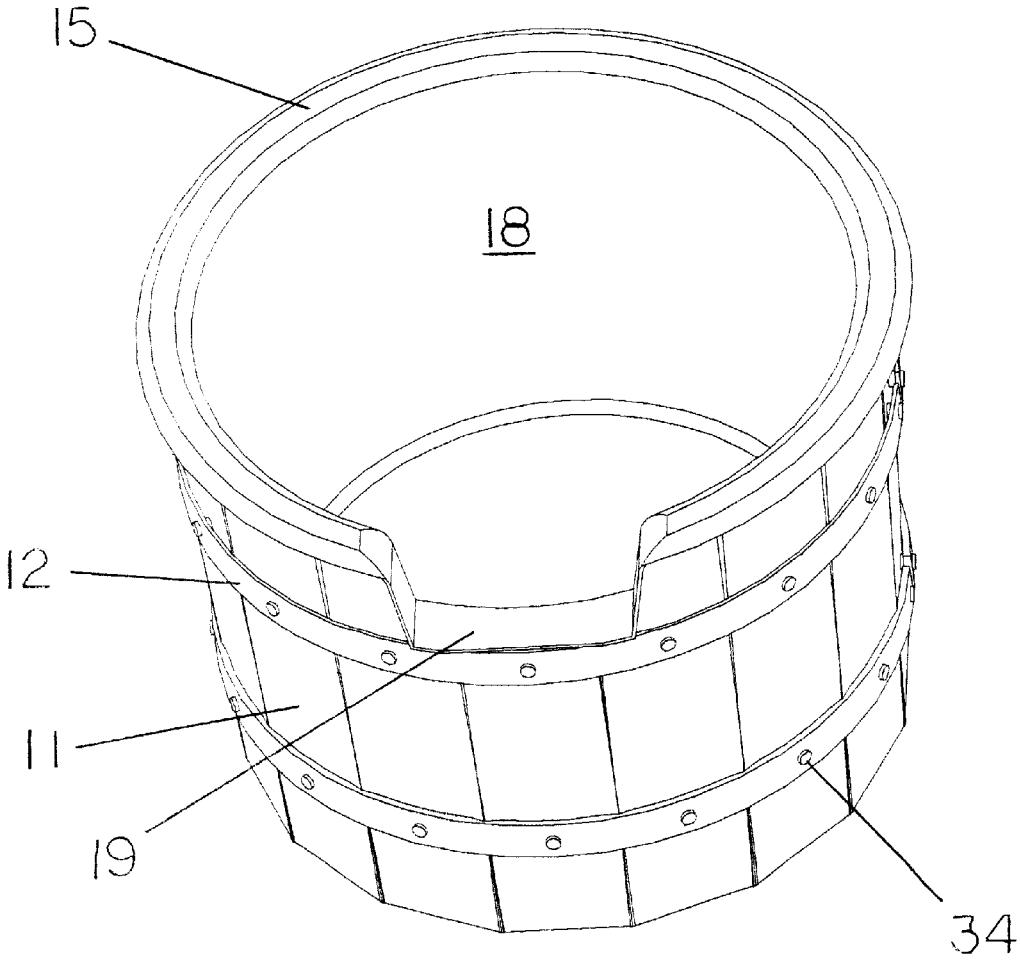
FIG. 17 is a top perspective view of a cascade liner assembled in a cascade notched barrel.
Figure 18:
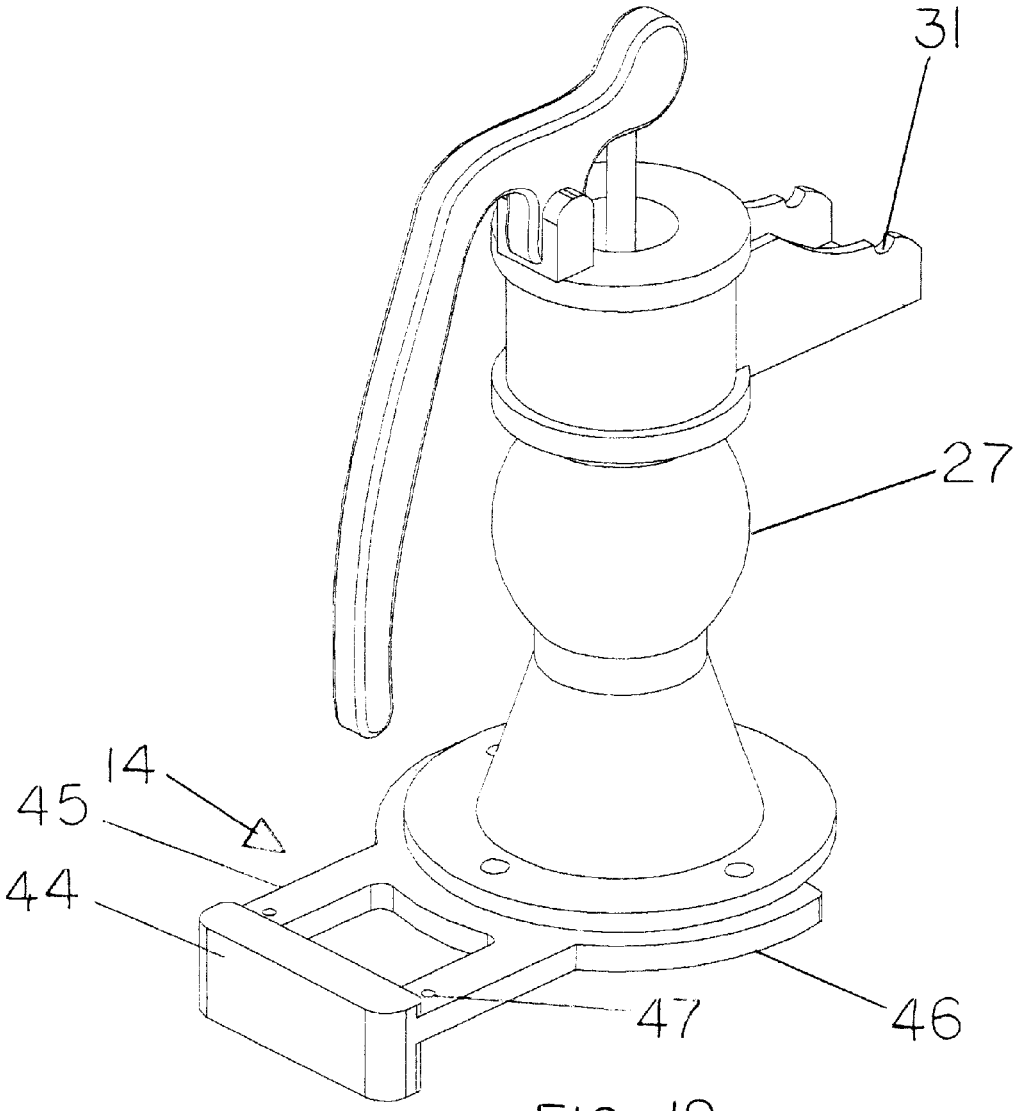
FIG. 18 is a top perspective rear view of a cast iron vintage pump.
Figure 19:
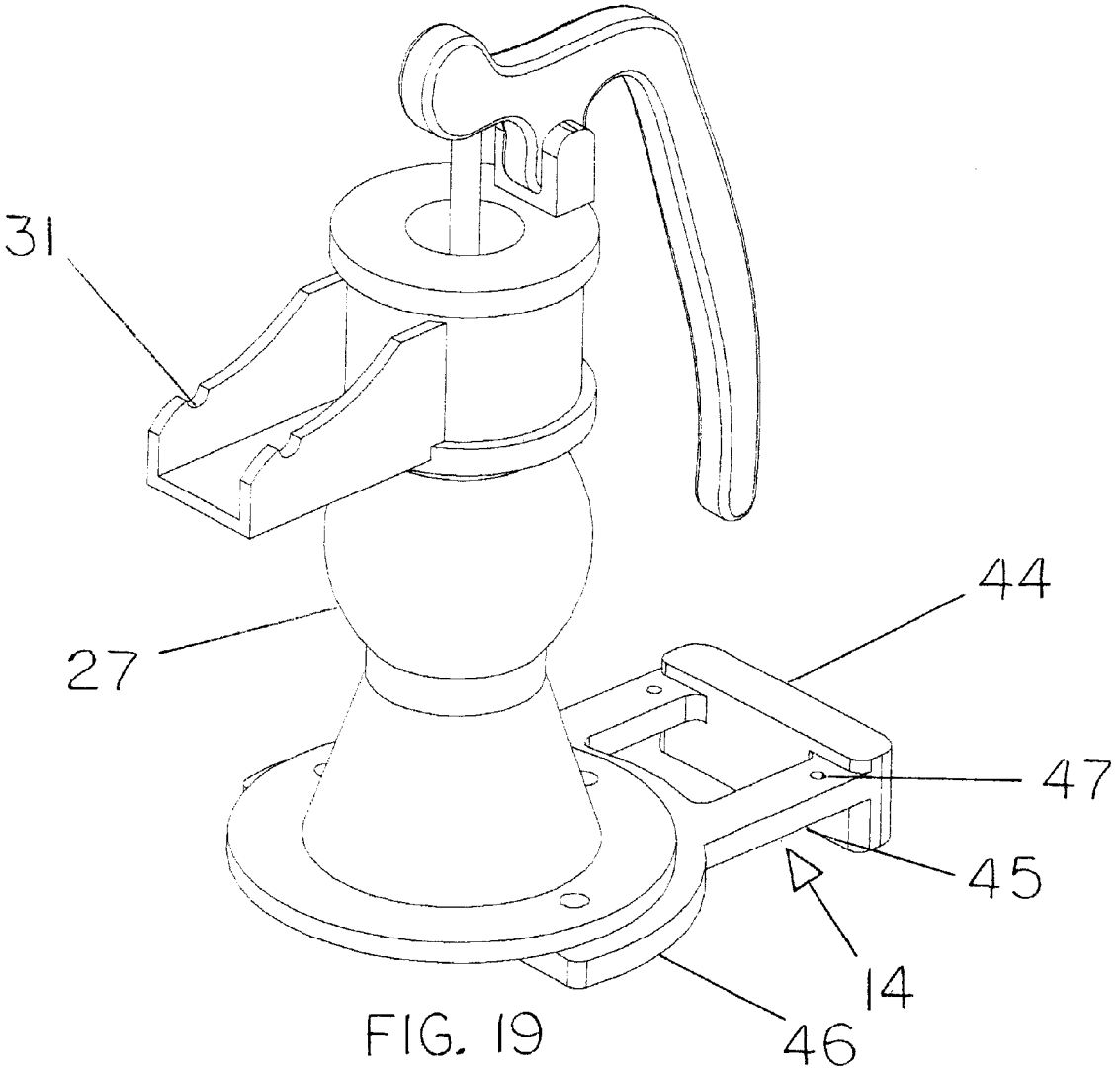
FIG. 19 is a top perspective front view of a cast iron vintage pump.
Figure 20:
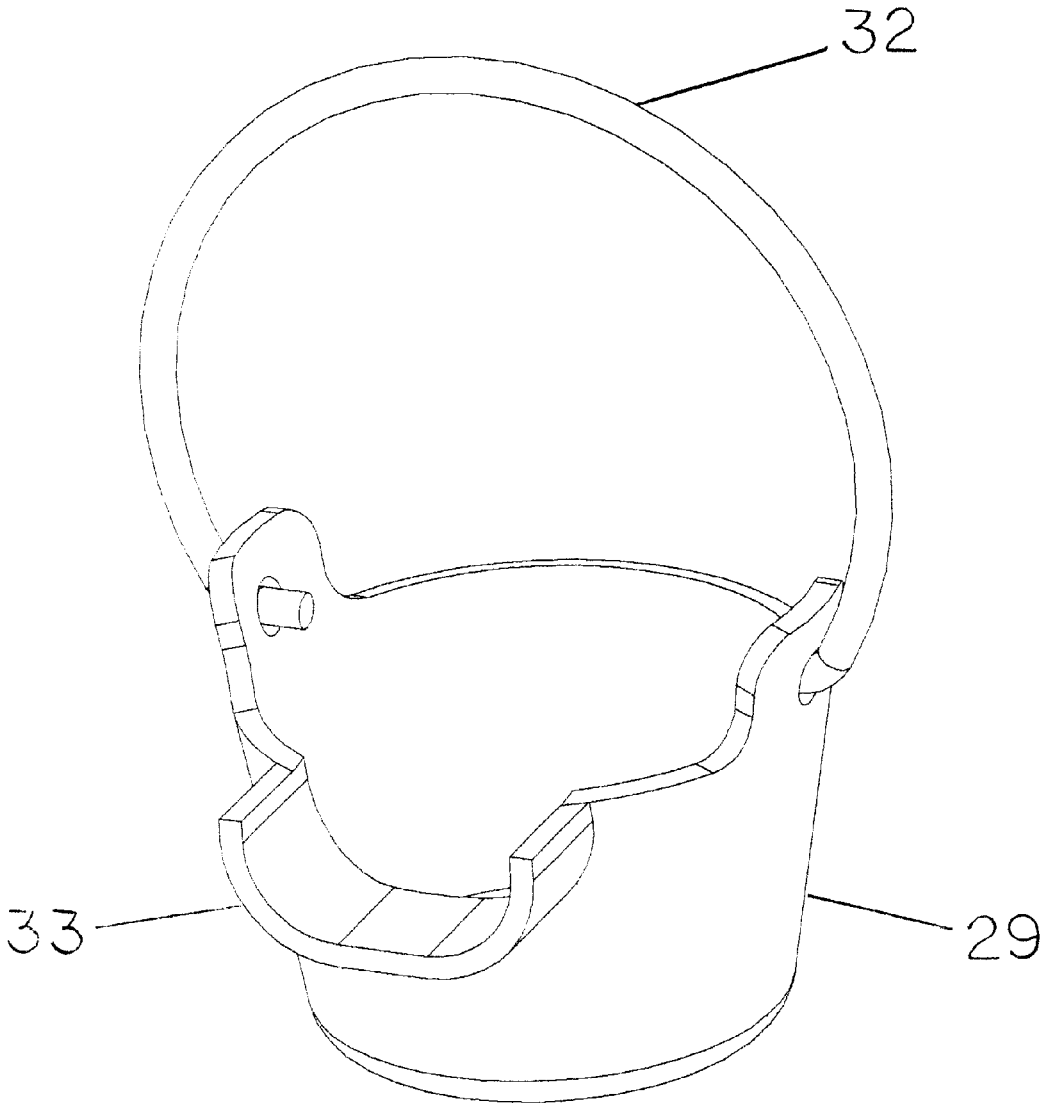
FIG. 20 is a top perspective view of a water bucket having a cascade lip.

A barrel liner 18 may be used to retain water for growing aquatic plants. Barrel liner 18 comprises a top rim 15 having a cascade lip 19 formed at one side. Cascade lip 19 is formed to fit within a cascade notch 36 formed in staves 11 as shown in FIG. 15. Liner side 35 is elongated to form a deep chamber for holding a quantity of water for use as an aquatic garden. The top rim 15 is shaped to fit over and engage the top edges 37 of barrel staves 11. The combination of the top edges 37 and the top rim 15 of the barrel liner 18 form a rigid, stand alone half barrel which can support the large weight of the aquatic water garden.

Barrel liners, classic design liner 17, cascade liner 18, with a cascade lip 19, planter ring liner 20, which can be filled with soil for planting with a center hole 21 to allow for the flow of water and planter ring liner 24 with a shelf 25 for mounting accessories such as a non-working pump or other ornamentation are all constructed with a top rim 15 for engaging the top edges 37 of staves 11. Classic design liner 17 fits barrel water garden 10 as well as most other whiskey barrels. Cascade liner 18 with cascade lip 19 allows water to cascade to a second barrel placed below. Planter ring liner 20 can be filled with soil for planting, 6" deep. In a preferred embodiment, the liners were made from high impact plastic.

FIG. 1 depicts the assembly of accessories by first fastening a mounting bracket 14 to the top rim 15. The cast iron vintage pump 27 is then fastened to mounting bracket 14 with fasteners 38 which, in a preferred embodiment, were stove bolts. Mounting bracket 14 consists of the rim mount 44, and a pair of parallel, spaced apart arms 45 extending horizontally from rim mount 44, each having curved extensions 46 forming a "Y" shape accessory mounting area. Mounting holes 47 are provided for mounting the bracket 14 on the rim 15 and mounting holes (not shown) are provided in extensions 46 for fastening the above described accessories with fasteners 38.

Figure 4:
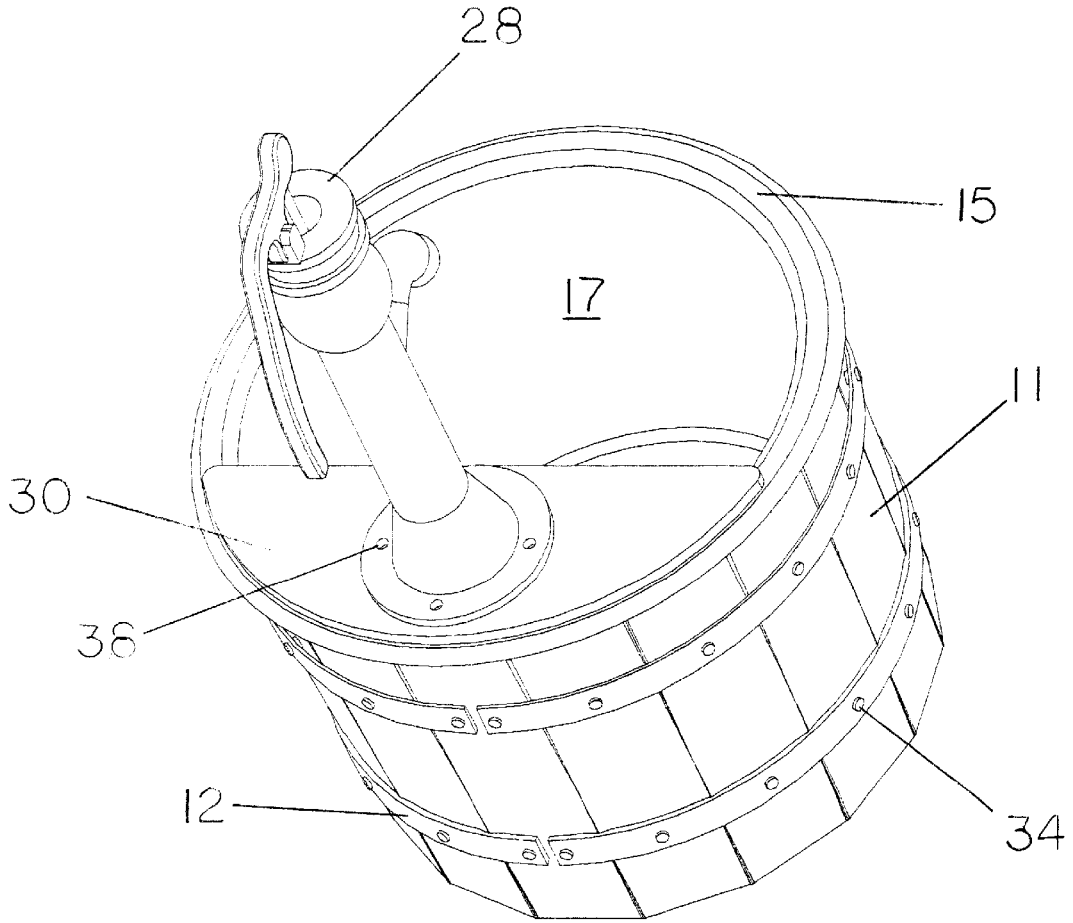
FIG. 4 is a top perspective rear view of a classic design liner with accessories mounted in accordance with the invention.
Figure 5:
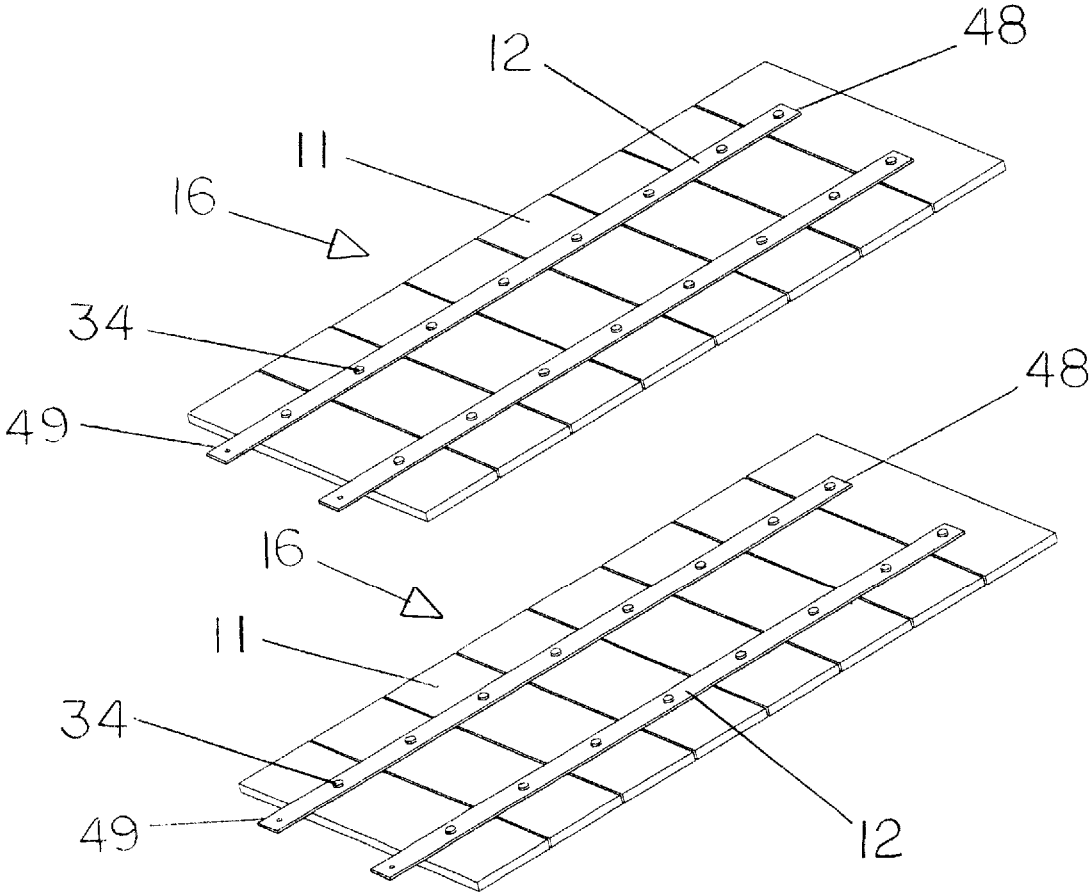
FIG. 5 is a top perspective view of two sections of the barrel assembly in accordance with the invention.
Figure 6:
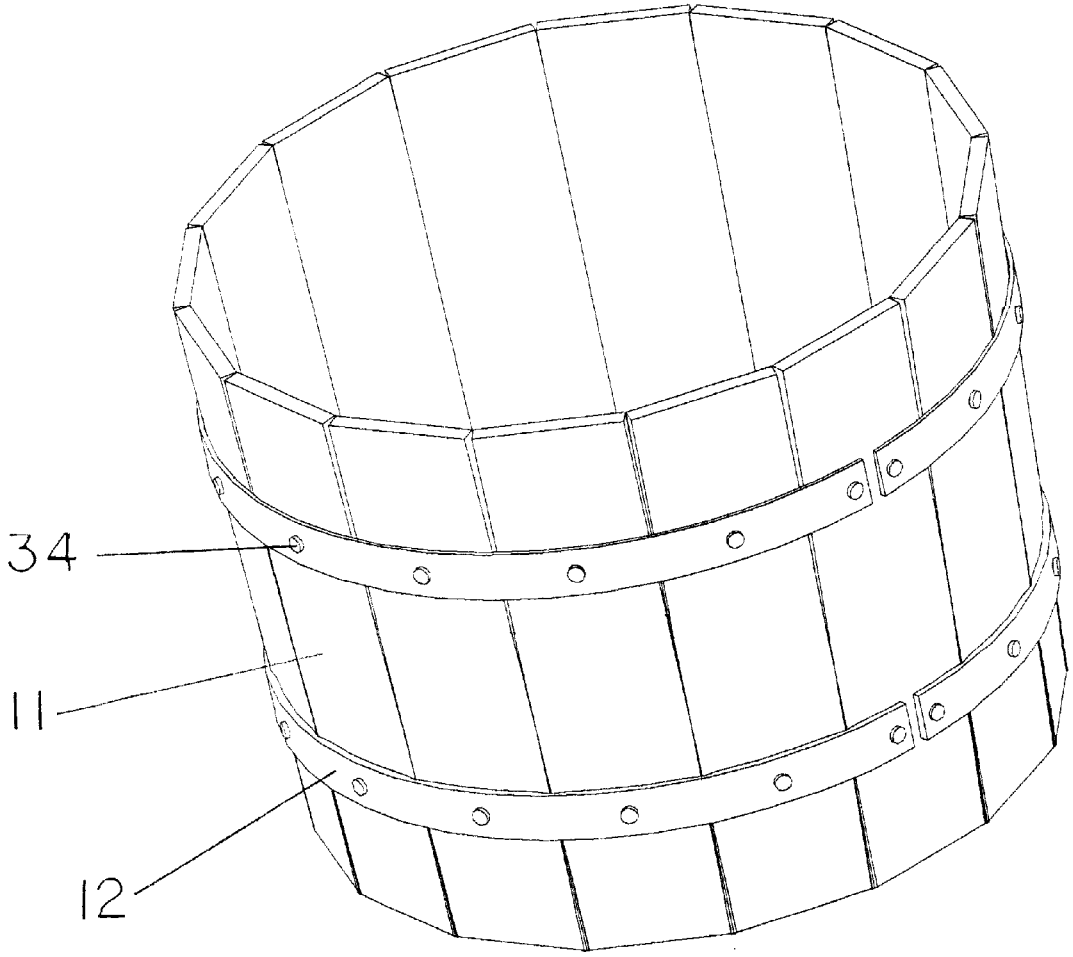
FIG. 6 is a top perspective view of the two sections joined to form the barrel in accordance with the invention.
Figure 7:
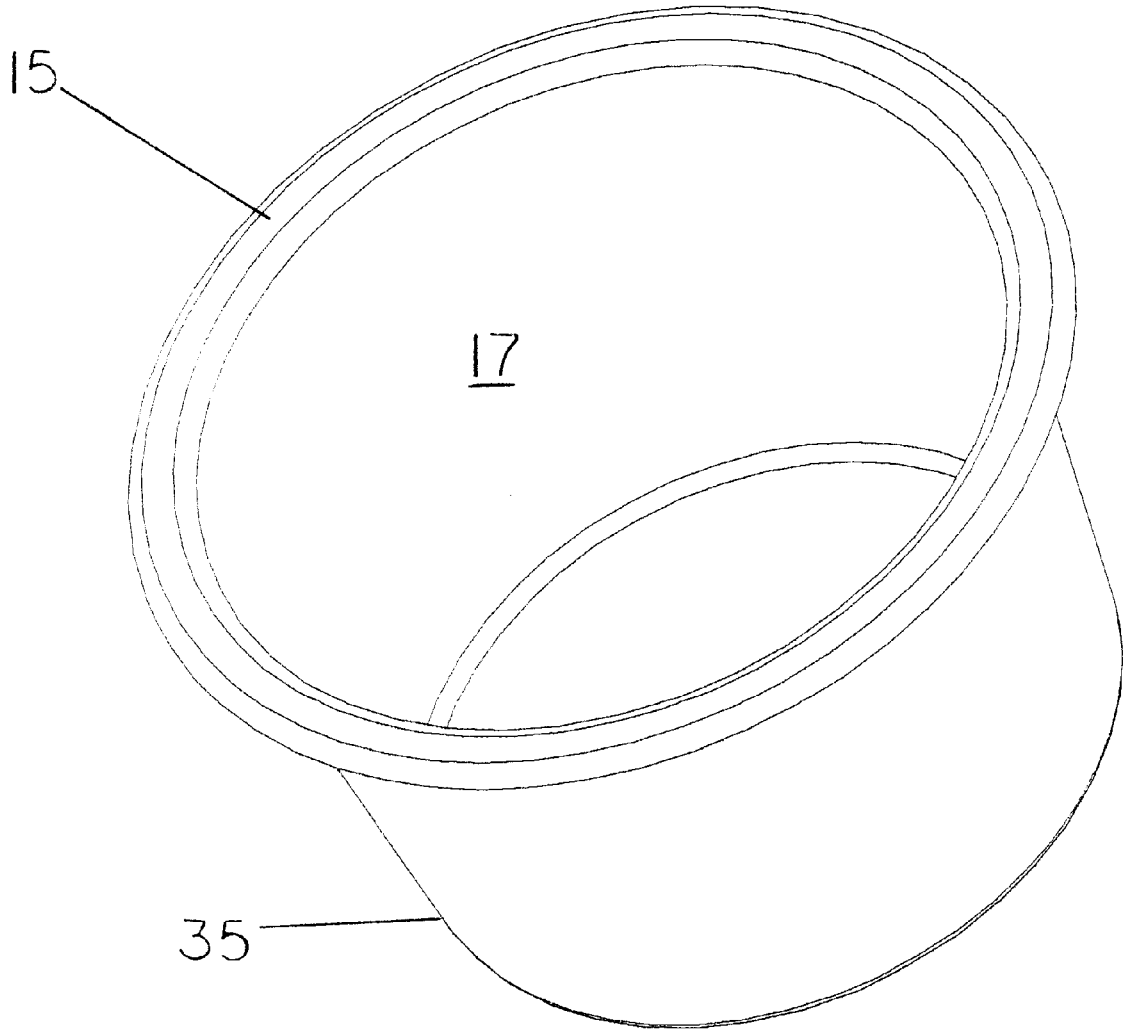
FIG. 7 is a top perspective view of a classic liner in accordance with the invention.
Figure 8:
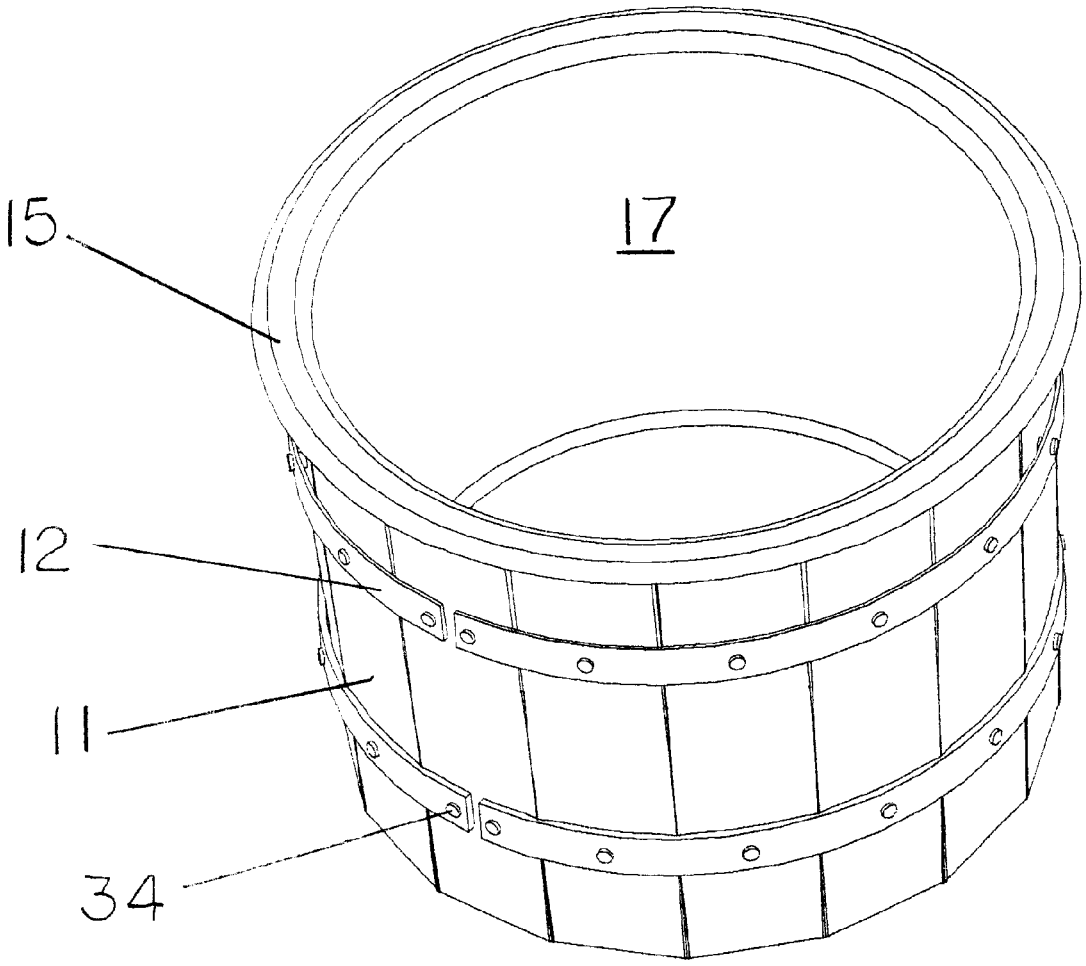
FIG. 8 is a top perspective view of the assembly of a classic liner with the barrel assembly in accordance with the invention.
Figure 9:
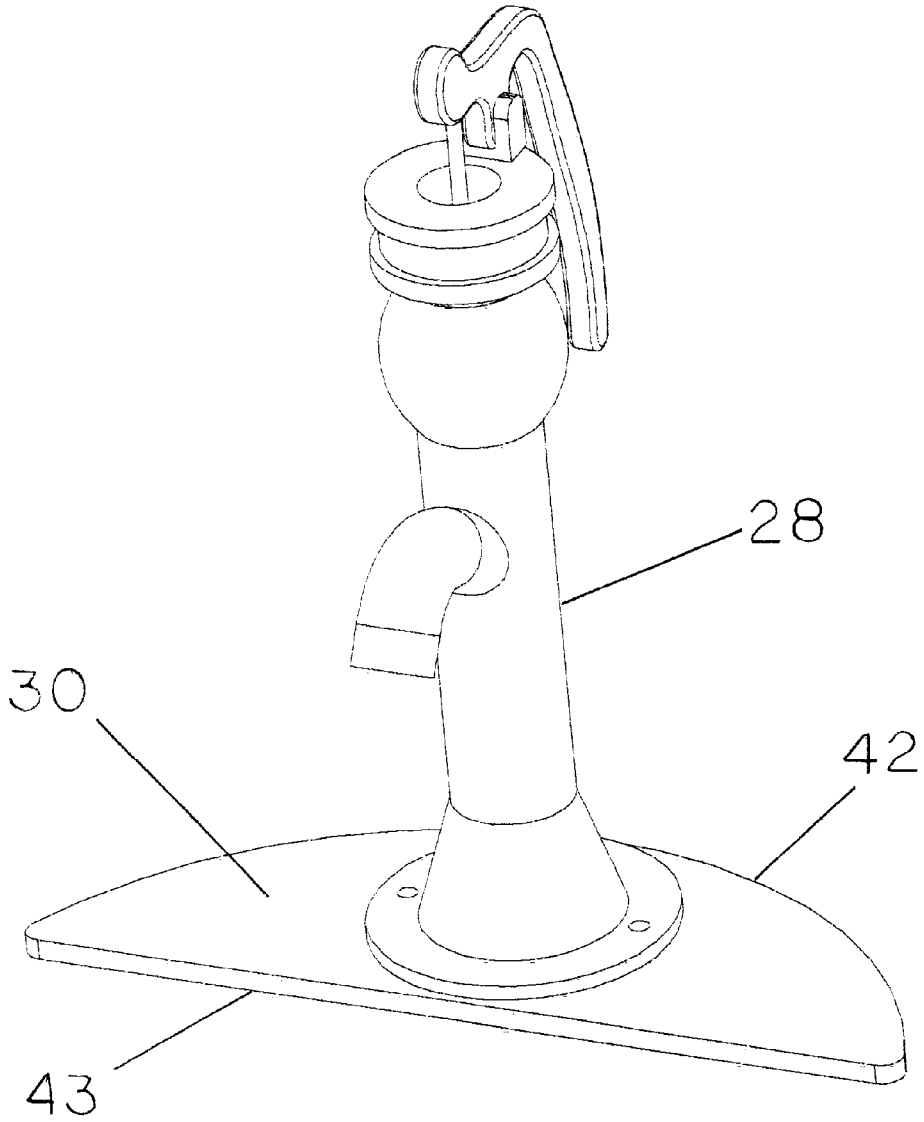
FIG. 9 is a top perspective front view of an aluminum country pump mounted on a mounting platform in accordance with the invention.
Figure 10:
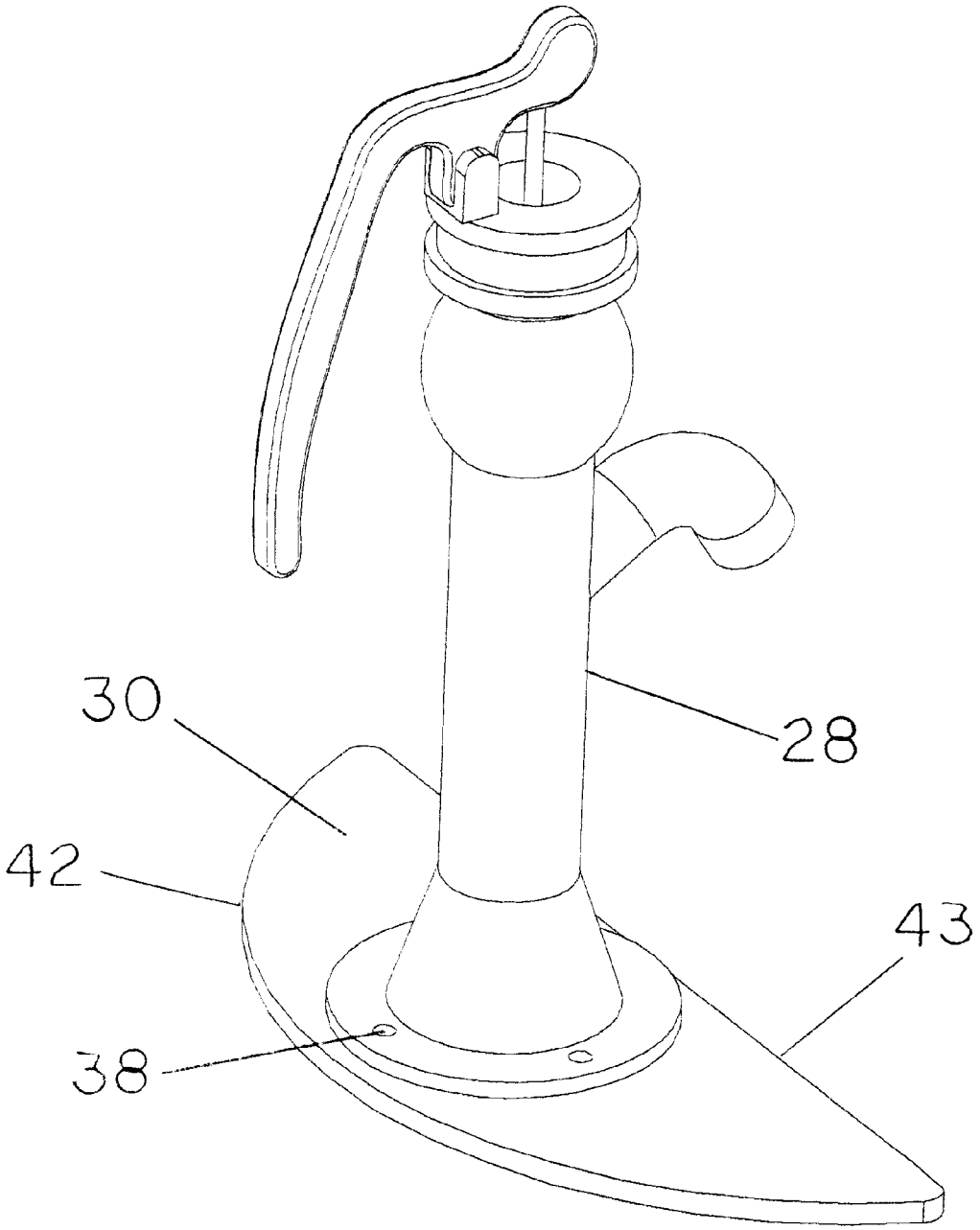
FIG. 10 is a top perspective rear view of an aluminum country pump mounted on a mounting platform in accordance with the invention.
Figure 11:
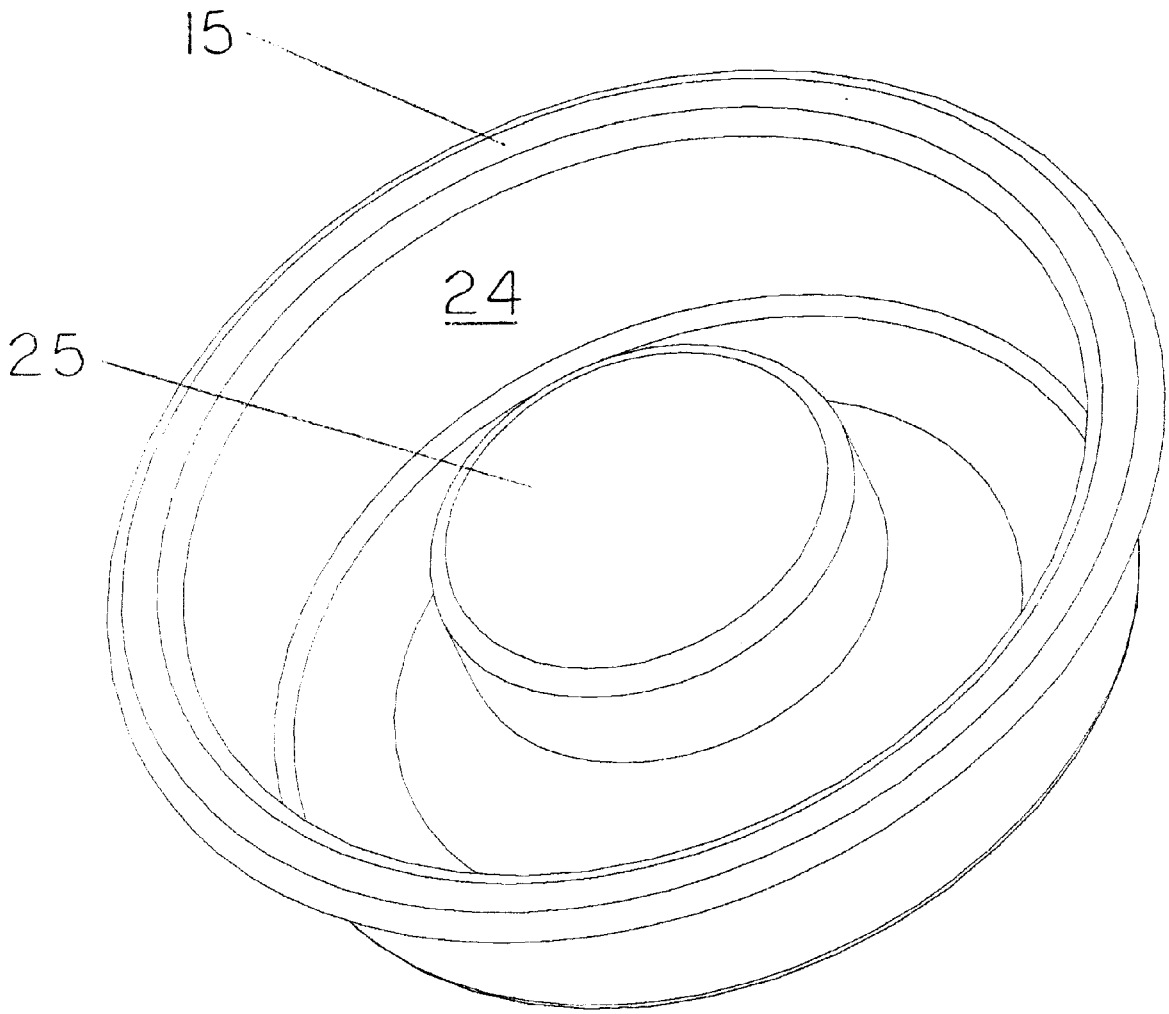
FIG. 11 is a top perspective view of a platform ring in accordance with the invention.
Figure 12:
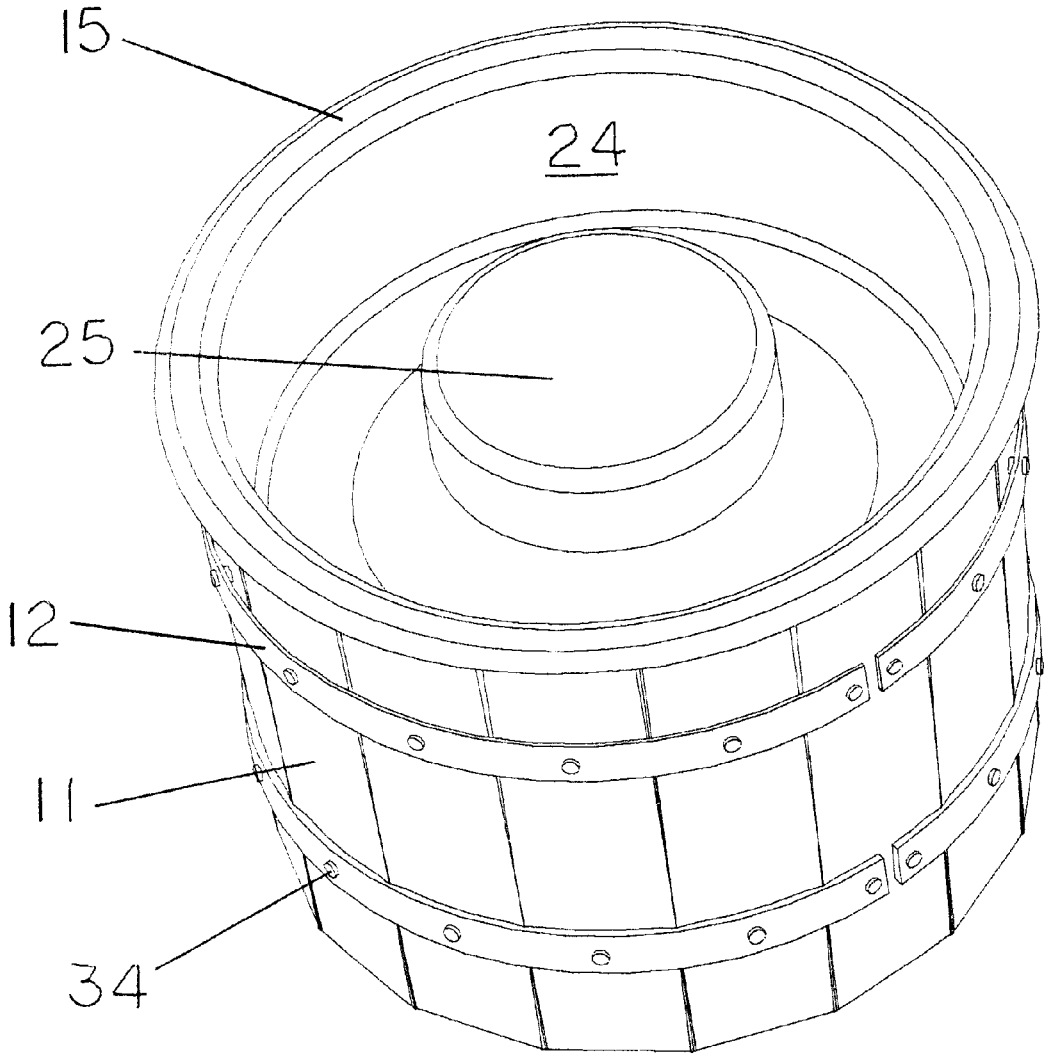
FIG. 12 is a top perspective view of a platform ring assembled in the barrel in accordance with the invention.
Figure 13:
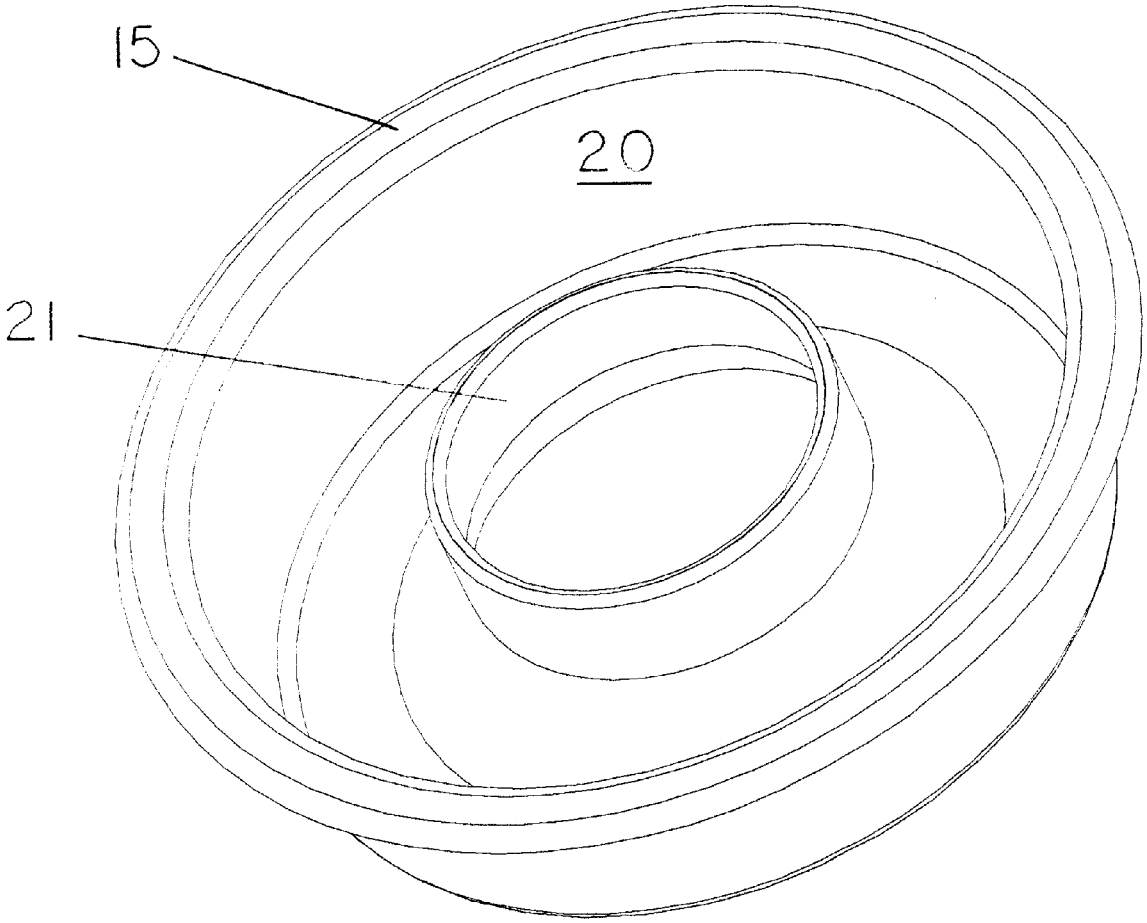
FIG. 13 is a top perspective view of a planter ring liner in accordance with the invention.
Figure 14:
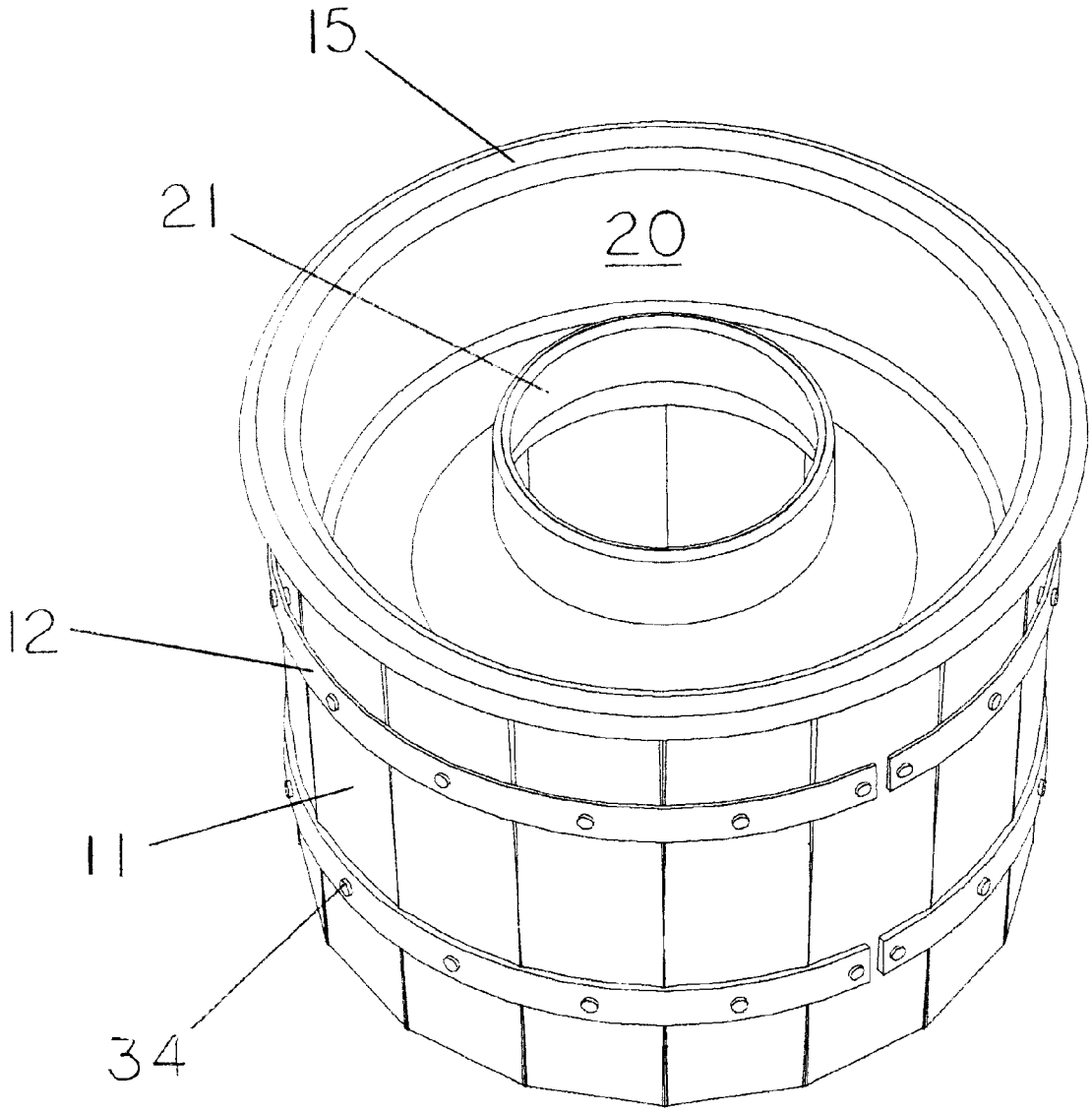
FIG. 14 is a top perspective view of a planter ring liner assembled in the barrel in accordance with the invention.

FIG. 4 depicts another embodiment which may be used to fasten accessories. Mounting platform 30 consists of a wooden panel cut to fit over the top rim 15 with a first edge 42 formed in an arc to fit over the top rim 15 and a second edge 43 running from opposite ends of the arc. Mounting platform 30 is mounted on the top rim 15 and an accessory such as aluminum country pump 28 may be fastened with fasteners 38. Mounting platform 30 may also be mounted on any of the other barrel liners described above.

A water pump (not shown) may be mounted on the underside of mounting platform 30 to provide a realistic flow of water from either of the pumps 27 or 28. Other accessories, such as a watering can (not shown) may also be used in the same manner as the pumps 27 and 28.

To provide a further effect, water bucket 29 may be hung from vintage pump 27 by hanging handle 32 in notches 31. Suspending the water bucket 29 in such a manner provides an additional effect of cascading water.

While a principle of the present invention has been described above in connection to a preferred embodiment of the invention, it is intended that all matter contained in the above description and illustrated in the accompanying drawings shall be interpreted to be illustrative and not in a limiting sense.

What is claimed is:

1. A simulated barrel garden for aquatic and terrestrial plants, said garden comprising:

a circumferential sidewall consisting of a first section and a second section of vertically extending barrel staves, each barrel stave having a top edge, a plurality of sections of barrel hoops fastened perpendicular to said barrel staves for holding said barrel staves in assembled relation, said barrel hoops each having an extension at one end for overlapping adjacent staves and connecting said first and second sections together, each said extension being fastened to one of said adjacent staves a barrel liner having a top rim, said liner being inserted into the space defined and enclosed by said sidewall and said top rim mating with said barrel stave top edges, and forming a rigid, stand alone half barrel supporting the weight of the garden, a mounting bracket fastened to said liner top rim, and a water related accessory fastened on said mounting bracket.

2. A simulated barrel garden for aquatic and terrestrial plants as defined by claim 1 and further characterized by, a cascade notch being formed in said barrel staves top edges and a mating cascade lip formed in said top rim of said barrel liner.

3. A simulated barrel garden for aquatic and terrestrial plants as defined in claim 1 wherein said water related accessory is a water pump.

4. A simulated barrel garden for aquatic and terrestrial plants as defined by claim 3 wherein a water bucket is hung from said water pump thereby forming a water cascade.

5. A simulated barrel garden for aquatic and terrestrial plants as defined in claim 1 wherein said barrel liner is formed with a planter ring with a shelf at its center.

6. A simulated barrel garden for aquatic and terrestrial plants as defined in claim 1 wherein said barrel liner is formed with a planter ring with a hole at its center.

7. A simulated barrel garden for aquatic and terrestrial plants, said garden comprising:

a circumferential sidewall consisting of a plurality of sections of vertically extending barrel staves, each barrel stave having a top edge, a cascade notch formed in said barrel staves top edges, a plurality of straps fastened to said barrel staves for holding said staves in assembled relation, said straps each having extensions at one end for overlapping adjacent staves and connecting said sections together, each said extension being fastened to one of said adjacent staves a barrel liner having a top rim and having a cascade lip formed in said top rim, said liner being inserted into the space defined and enclosed by said sidewall and said top rim and said cascade lip each mating with said barrel stave top edges and forming a rigid, stand alone half barrel supporting the weight of the garden, a mounting bracket fastened to said liner top rim, said mounting bracket consisting of a rim mount, and a pair of parallel, spaced apart arms extending horizontally from said rim mount, each of said arms having curved extensions forming a "Y" shape accessory mounting area, and a simulated pump fastened to said mounting bracket and a water bucket having a cascade edge hung on said water pump.

* * * * *